US006067851A

United States Patent [19]

Chaves et al.

[11] Patent Number: 6,067,851

[45] Date of Patent: May 30, 2000

[54] PRESETTABLE LAUNCHABLE VEHICLE SYSTEM AND METHOD

[75] Inventors: Robert J. Chaves, Portsmouth, R.I.; Charles Ferreira, Jr., Swansea, Mass.

[73] Assignee: The United States of America as represented by the Secretary of the Navy, Washington, D.C.

[21] Appl. No.: 09/168,333

[22] Filed: Oct. 5, 1998

[51] Int. Cl.[7] ..... F41A 31/00

[52] U.S. Cl. ..... 73/167; 89/1.8

[58] Field of Search ..... 89/1.8, 1.809, 89/1.1, 1.81; 114/238; 73/167; 42/1.01

[56] References Cited

U.S. PATENT DOCUMENTS

| | | | |
|---|---|---|---|
| 4,541,191 | 9/1985 | Morris et al. | 42/1.01 |
| 4,597,345 | 7/1986 | Reeser et al. | 114/20.1 |
| 4,686,886 | 8/1987 | Caserza et al. | 89/11 |
| 5,771,741 | 6/1998 | Roy et al. | 73/167 |

*Primary Examiner*—Stephen M. Johnson
*Attorney, Agent, or Firm*—Michael J. McGowan; Prithvi C. Lall; Michael F. Oglo

[57] ABSTRACT

A test system and a method for testing the final stages of a submarine weapon fire control system so as to obtain a complete end-to-end test of the submarine weapon fire control system. The test system includes a launchable test vehicle that can be inserted and launched from a launch tube such as a torpedo launch tube. The test vehicle is the same size and shape as standard launchable vehicles of the type to be tested and preferably includes actual fleet replacement standard components. The test vehicle includes a data recorder that passively records a plurality of signals including power related signals, power crossover signals, preset information, launch sequence information, processor record data, and the like. The test system also includes a data extractor that is used to extract data from the test vehicle in between launches from subsequent launch tubes. The data extractor connects to an umbilical connection on the test vehicle that is normally broken during each launch. The data extractor is portable and includes a portable computer and power supply. The data extractor can be used to present much of the above data for immediate view with respect to time. Quantitative analysis of the data can be made at a later time as desired.

20 Claims, 3 Drawing Sheets

PRESETTABLE LAUNCHABLE VEHICLE SYSTEM AND METHOD

STATEMENT OF THE GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

The present invention relates generally to testing and evaluation of a complex system and, more specifically, to verifying operation of a submarine weapon fire control system to a high degree of confidence prior to live firing.

(2) Description of the Prior Art

Presettable launchable vehicles refer to modern digital launchable vehicles, such as torpedoes, in which various information is preset prior to launching and various information is measured and recorded during an actual launch. The submarine weapon fire control system comprises systems for launching presettable launchable vehicles that are difficult to test thoroughly with quantitative results as is desirable prior to live firing. In fact, it is highly desirable to test a weapons system for submarines and ships from which launchable vehicles may be dispatched prior to leaving the shipbuilder or the dock and conducting live firing verification in exercises or combat. However, to completely test a presently used submarine weapon fire control system would, among other trials, require testing the entire system including torpedo tubes, air firing valve, turbine ejection pump, weapon ejection velocity, guidance wire integrity after launch, isolation timing, and other factors in conjunction with other submarine weapons fire control system elements.

Testing the submarine weapons fire control system is not the same as a testing system for the launchable vehicle, such as a torpedo. A torpedo that is otherwise operational may fail to initiate its start sequence due to a problem in the submarine weapons fire control system. Even though testing the submarine weapons fire control system is not the same as testing a torpedo system, due to the interaction between the two systems it would be desirable to have quantitative internal readings from the torpedo circuitry prior to and even subsequent to the launch for purposes of evaluating the submarine weapons fire control system.

While weapon simulators can be used for some purposes in testing the submarine weapons fire control system, such simulators have numerous problems for "end-to-end" testing. Some, but not necessarily all, of the problems of relying on weapon simulators alone include the following:

(a) Weapon simulators are capable only of go/no-go verification of the weapon interface and are not capable of providing the detail of data necessary for quantitative analysis;

(b) Weapon simulators cannot be launched from the submarine or ship to assess launch damage while exiting the torpedo tube and transiting through the launch way and shutter areas;

(c) Actual high and low weapon power electrical loads, including activated and inactivated remote power supplies, that typically change due to weapon status are not provided while interfacing with the submarine combat system of the weapon simulator;

(d) Weapon simulators can respond to weapon interface signals that are outside the specification requirements;

(e) The electric load characteristics of the simulator such as for guidance wire and dynamic gyro do not reflect actual loads which may be dynamic rather than static and/or include reactive loads rather than purely resistive loads;

(f) The weapon simulators tend to respond much faster than actual torpedo hardware;

(g) The weapons systems cannot determine whether A-Cable separation will occur prior to system dead face or isolation. Failure of this isolation to successfully initiate can cause substantial damage to the submarine combat system equipment; and (h) The weapon simulators guidance wire tone processing is not handled the same as in an actual torpedo.

Consequently, there remains a need for being able to completely test the submarine weapons fire control system from end-to-end in a manner that provides quantitative data and also provides a very high degree of confidence that the system as a whole will reliably accomplish its purposes, some of which are listed above. Those skilled in the art will appreciate the present invention that addresses the above and other problems.

SUMMARY OF THE INVENTION

A test system is provided for testing a submarine weapons fire control system suitable for launching weapons such as torpedoes or other vehicles from a launch tube. The test system comprises a launchable test vehicle sized just as a standard fleet issue vehicle so as to be operable for insertion and launching from the tube launcher. However, the launchable test vehicle preferably has no warhead or fuel. The test vehicle is equipped so as to provide a realistic simulation but, if desired, could be configured differently to test the system with a new or different type of weapon. Preferably the test vehicle includes genuine fleet replacement items such as a fleet issue replacement guidance wire, and a fleet issue replacement gyro and control (G&C) section. Preferably, weights are secured to the test vehicle in place of the warhead and the fuel for adjusting a weight of the test vehicle to have substantially the same buoyancy, center of gravity (COG), and same center of buoyancy (COB) as the fleet issue vehicle. The launchable test vehicle has at least one sensor mounted to the test vehicle and typically has a plurality of sensors. The test vehicle normally has a plurality of power supplies.

Within the test vehicle, a data recorder is mounted for passive connection to various circuitry within the test vehicle such as for monitoring data related to the internal sensors and data related to the plurality of power supplies prior to, during, and subsequent to the launchable test vehicle being launched from the tube. The test vehicle is constructed so that a data extractor is connectable to the launchable test vehicle after the test vehicle is launched from the tube. The data extractor is then able to communicate with the data recorder. The data extractor is preferably portable and preferably connects to an umbilical connection that separates from the weapon control system when the launchable test vehicle is launched. The data extractor includes a portable computer for retrieving and displaying data from the data recorder. The data extractor may also include a portable power supply, if other suitable power is not available. The portable computer is operable for immediately displaying various data with respect to time, e.g., data comprising time-tagged test vehicle velocity. Power information may also be displayed immediately with respect to time, e.g., battery voltage, the relevant crossover power source at the particular time in question, and the various power supply voltages. The system is also operable for immediately displaying a plurality of launch sequence control signals with respect to time.

For safety purposes, sensors are used to provide a safety interlock. For instance, the launch must achieve a certain velocity before the start signal can be activated.

A crossover circuit in the launchable test vehicle is used for controlling the origin of power for the launchable test vehicle, e.g., weapon control power or battery power from the test vehicle. A battery power supply is provided for the data recorder. To extend battery life, the battery power supply for the data recorder is preferably controlled or switched on by the crossover circuit.

A method is provided for testing a submarine weapons fire control system that includes a plurality of tube launchers for launching a fleet vehicle sized to be ejected from the tube launcher. The method comprises inserting a data recorder into a test vehicle, attaching passive electrical lines from the data recorder to various control circuits, data lines, and the like. As well, passive connections are made to the test vehicle power circuits that typically include the crossover circuits that, as discussed above, switch between internal vehicle power and weapon control system power. The test vehicle is inserted into a first of the plurality of tube launchers. A first launch sequence is initiated to thereby launch the test vehicle from the first of the plurality of tube launchers. The test vehicle is retrieved and subsequently inserted into a second of the plurality of tube launchers. A second launch sequence is initiated to thereby launch the test vehicle from the second of the plurality of tube launchers. This process can go on with other tubes until the testing is satisfactorily completed. Of course, the test vehicle could be placed into the same tube for retesting, if desired. During each launch an electrical connection is made between the submarine weapons fire control system and the test vehicle, and then typically the electrical connection is broken during the launch sequence. As suggested above, the test vehicle is essentially a fleet issue vehicle, such as a torpedo, from which selected components are removed.

Data is recorded during the pre-launch, launch, and post-launch stage with the data recorder. The recorded data relates to various circuits of the test vehicle such as control circuits and power circuits. Preferably, data related to any launch sequence is collected after retrieving the test vehicle and before the next launch. Data extraction is accomplished by providing a portable data extractor, connecting the portable data extractor to the test vehicle after the retrieving of the test vehicle, and extracting data from the data recorder. Preferably a computer program is provided for extracting data from the data recorder and for giving the test vehicle a self-test.

It is an object of the present invention to provide an improved system and method for testing a submarine weapons fire control system.

It is another object of the present invention to obtain quantitative information regarding the submarine weapons fire control system from internal launchable vehicle circuits, such as those found in a torpedo or other launchable vehicle.

It is yet another object of the present invention to provide an apparatus and technique that can verify end-to-end operation of a submarine weapons fire control system that is useable dockside or while still at the contractor.

A feature of the present invention is a launchable test vehicle that can be repeatably launched from a tube launcher.

Yet another feature of the present invention is a portable data extractor that can be used to extract information in between launches of the test vehicle.

An advantage of the present invention is the ability to determine with a high degree of confidence prior to live firing that the submarine weapons fire control system will operate as expected.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

BRIEF DESCRIPTION OF THE PREFERRED EMBODIMENTS

Figure 1:
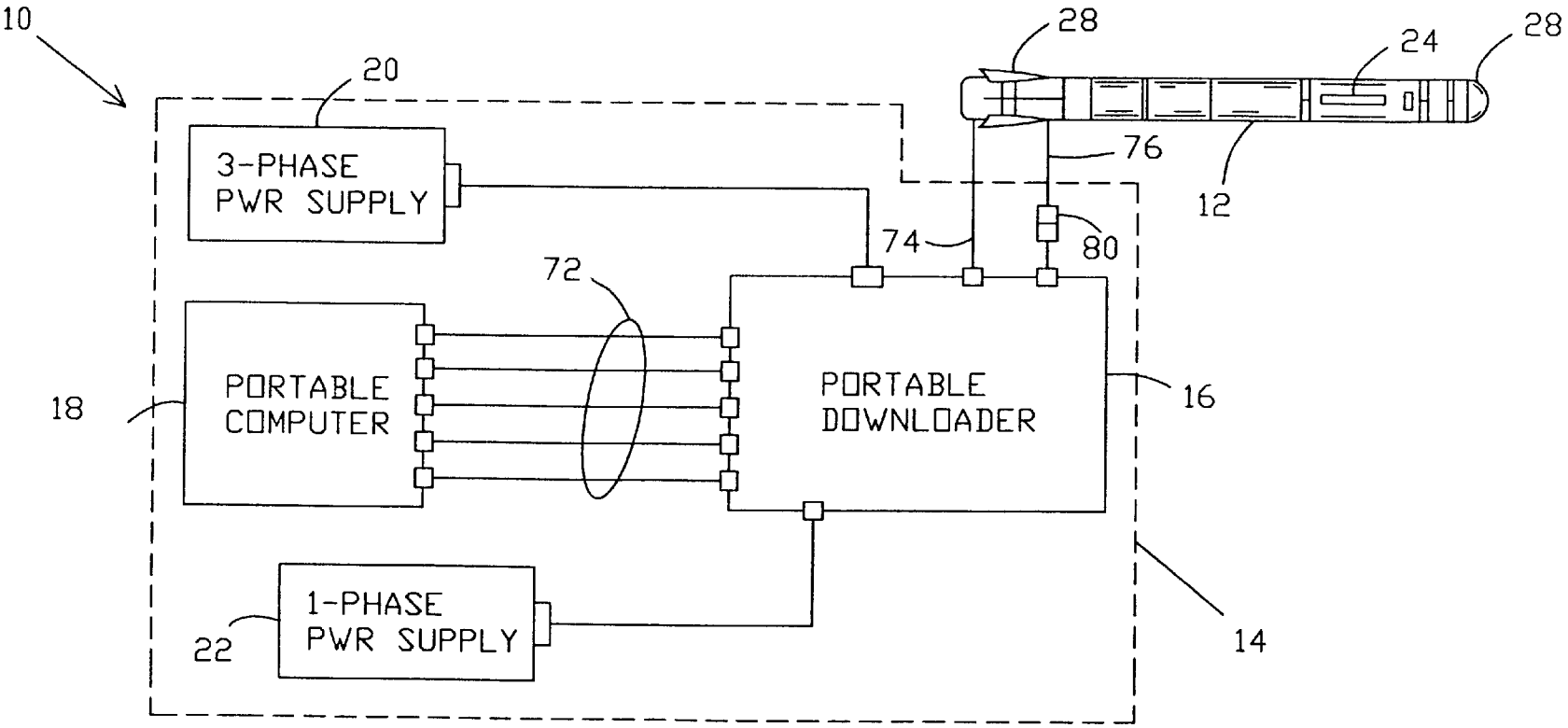
FIG. 1 is a block diagram of a presettable launch vehicle in a configuration with a data extractor.

Referring now to the drawings and more specifically to FIG. 1, there is shown a presently preferred embodiment of test system 10 that includes a presettable launch vehicle for test purposes, such as test torpedo 12, connected to data extraction system 14 that includes elements such as portable downloader unit 16 and portable computer 18. Power supplies may also be effectively included such as portable three-phase power supply 20 that may preferably be used for a dockside readiness test only and/or 115 volt ac power supply 22 typically available as pier power. Appropriate software is also included in test system 10 for data extraction purposes. Test system 10 is able to measure, record, and display for post test analysis the launch dynamics to determine end system factors, e.g., whether all interlocks were successfully satisfied. Test system 10 provides information leading to high confidence that the weapon control system works so that a torpedo accomplishes all start up requirements to initiate ignition of the torpedo to start running under its own propulsion system. Test system 10 will certify that a submarine combat system and launcher system has power levels, communication, presetting signals, and dynamic launcher requirements that are within specifications for a successful launch and torpedo startup. Test system 10 also provides written quantitative evidence that trajectory boundary requirements of the exiting torpedo are satisfied. It should be noted that numeral 72 designates a 5-conductor insulted interface cable as shown in FIG. 1.

Figure 2:
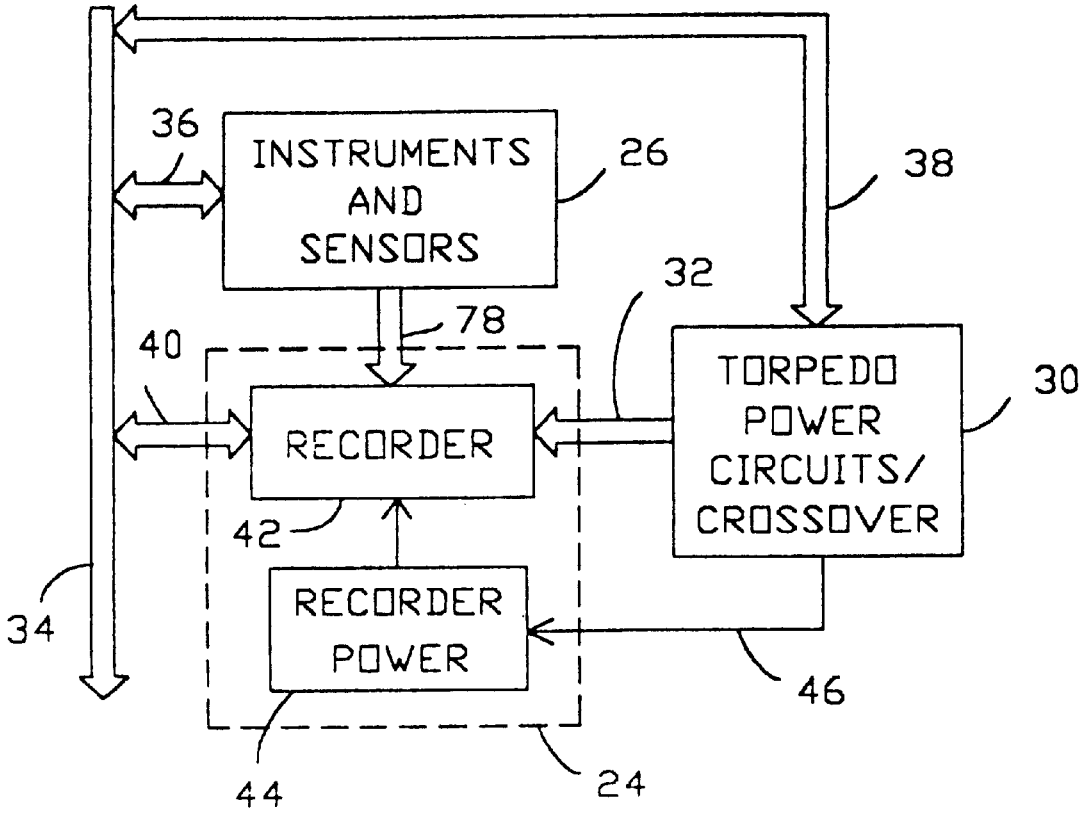
FIG. 2 is a block diagram indicating internal interconnections between a portable launch vehicle recorder and launchable vehicle circuitry in accord with the present invention.

Test vehicle or test torpedo 12 is preferably constructed using actual torpedo hardware and preferably contains a fleet issued guidance and control hardware section and other fleet issued standard functional item replacements. Test torpedo 12 is effectively an actual fleet torpedo but does not include either fuel or an actual warhead. Additionally, test torpedo 12 is modified to include an internal recorder package 24 interconnected for monitoring desired signal points within the standard torpedo electronics as discussed hereinafter and as indicated in FIG. 2. Preferably internal recorder package 24 is used as a substitute for the warhead. With the exception of fuel and explosive considerations, test torpedo 12 would be loaded, handled, and shipped in the same manner as a fleet prepared war shot torpedo. Preferably, iron weights 28 are added fore and aft to adjust the buoyancy to a torpedo fleet exercise weight that may typically be buoyant positive. Since test torpedo 12 is positively buoyant, test torpedo 12 may be tube launched, retrieved, data extracted as discussed subsequently, and immediately shipped onboard for reuse to support testing on another torpedo tube.

Figure 3:
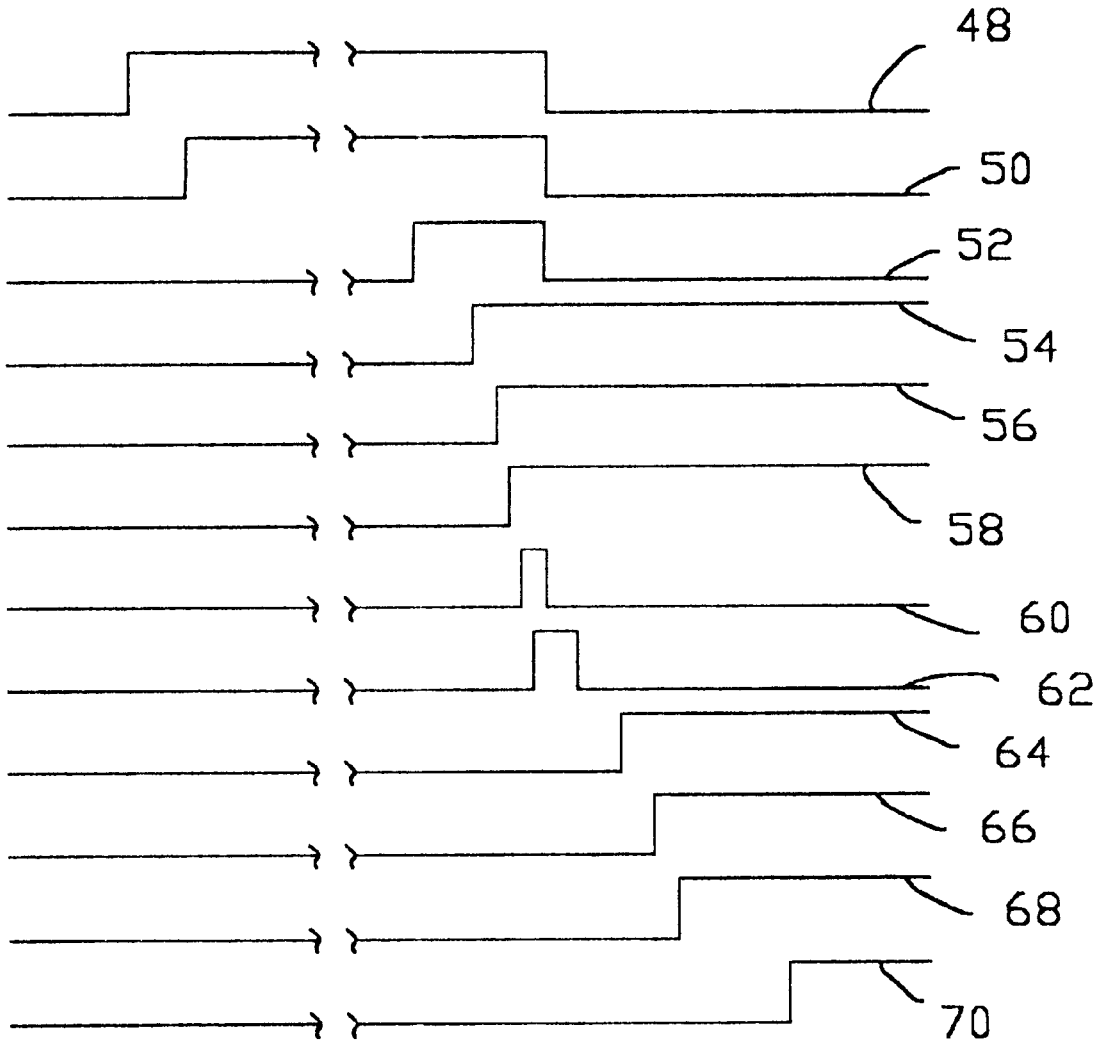
FIG. 3 is a signal sequence diagram of at least a few relevant launchable vehicle and submarine combat control data signals.

In FIG. 2 a general block diagram of internal data recorder 24 for presettable launch vehicle 12 is shown to be passively interconnected with torpedo instruments and sensors 26 by passive monitoring links, such as link 78. Passive monitoring links such as link 78 may typically have many interconnections and may be used to monitor and record many signals simultaneously. Likewise, internal data recorder 24 passively monitors power circuits 30 such as the voltages thereof through passive monitoring link 32. Internal data recorder 24 collects and stores pre-launch and launch data for the submarine weapons fire control system including the launch system as well as torpedo data. Data from internal data recorder 24 can be extracted through umbilical link 34 that is normally used to link the submarine weapons fire control system with torpedo instruments/sensors 26 and torpedo power circuits 30 with bidirectional links 36 and 38, respectively. Data on umbilical link 34 from the torpedo circuits can also be monitored for storage by internal data recorder 24 with link 40, as desired. In FIG. 3 a display of torpedo/combat control data is disclosed as discussed hereinafter. Umbilical link 34 preferably includes a breakable portion or connector that breaks during ejection. This breakable portion, discussed hereinafter, is preferably located externally with respect to the outer shell of test vehicle 12.

Internal data recorder 24 preferably includes a recorder, such as digital signal recorder 42, and preferably includes its own power supply 44, such as a 12-volt power supply. Prior to launch, recorder power may be received over link 40 from the submarine weapons fire control system or through torpedo power circuits 30, which may also originally receive power from the submarine weapons fire control system, to thereby conserve battery power. Control line 46 may be used to turn on recorder power 44 when or just prior to opening or breaking umbilical link 34 during the launch sequence.

Internal data recorder 24 preferably monitors up to about twenty preset function signals. Typically, the torpedoes have a monitor signal that is also recorded by internal data recorder 24. Warm up power voltages/currents as well as post launch power voltages/currents may be monitored which may include 5 volts idle and poet launch power supplies, +/−19 volt dc power supply voltages, 28-volt dc power supply voltage and a 48-volt battery power voltage. An identification signal for the torpedo is preferably recorded. Launch sequence signals such as the launch sequence signals of FIG. 3, and possibly others, are recorded. A series of twelve launch sequence signals may include a fire signal, battery command 1, battery command 2, battery ready, warm power relay, impulse command 1, impulse command 2, main motor start, inertial switch, wet probe, ignitor command 1 and ignitor command 2. Other information preferably to be recorded would include the torpedo data processor record data such as the preset information as well as autopilot data processor record data that would also include sensor data such as depth, inertia, and other sensor data. For instance, a torpedo may have a safety interlock that requires the torpedo ejection system to eject the torpedo at a sufficient ejection velocity before the torpedo will switch on so as to prevent accidental operation. Other interlocks may also prevent accidental operation. The guidance wire control status before and after launches may also be monitored. Data may be sampled at desired time intervals at a sufficient sampling rate to provide the necessary quantitative information for verification of system operation. Time tags are preferably generated within recorder 24 for various types of recorded data as discussed subsequently with respect to data extractor 14

For illustration purposes only, FIG. 3 discloses some possible pre-launch signals as well as some launch sequence signals. Prior to the fire signal, operator power 48 and weapon ready 50 signals will be activated. At fire signal 52, a series of launch sequence signals occurs that are recorded for a playback. Battery command 54 will provide for initiating a crossover from weapon systems operator power to torpedo battery power. As can be seen, operator power may turn off at the falling edge of fire signal 52, or as otherwise desired so that power is not applied to umbilical cord 34 when it disconnects during the torpedo ejection cycle. Batteries ready signal 56 indicates that the torpedo batteries that are part of torpedo power circuit/crossover 30 are ready. Subsequently signals such as impulse return 60 and main motor start 62 are given. Inertia switch signal 64 may be used as an interlock signal that occurs at a certain time in the ejection signal such as when the inertia of the torpedo is two g's. Wet probe signal 66 may be used as an additional safety interlock signal to verify the torpedo is in water. Igniter squib signal and engine start signals may be among the last signals of the launch sequence. As noted above, additional launch sequence signals may also be recorded where used. numerals 58, 68 and 70 refer to signal carrying lines with no signal on them and are there to be used later on if needed.

After the test torpedo is launched from the torpedo launch tube and then subsequently retrieved onto a pier or other convenient position, such as with standard procedures at the shipyard or dock, the data can be extracted. Then a test of the system using a subsequent launch tube can commence. Portable download unit 16 contains circuitry for controlling power as available as well as for connecting with portable computer 18. If pier power 22 is available, then a portable power supply such as three phase power supply 20 is not necessary. Information from internal recorder 24 is provided to computer 18 through portable downloader unit 16 through cables which may include digital data input output busses, wireguide signals, power, control signal busses, interface connections, and the like. Wireguide 74 and replaceable cable 76 that connects to the umbilical cord may be connected to portable downloader unit 16. Cable 76 is typically disconnected during launch and must be replaced after each use and preferably connects to umbilical connection 34. Connector 80 is a breakable connection and may be placed in a convenient position including being mounted onto test vehicle 12. Data extractor 14 allows extraction of recorded data from test torpedo 12 over umbilical cable 34 and allows execution of a test torpedo 12 self-test. Once data is extracted, it is preferably stored on media such as a Bernoulli® drive of computer 18 and can be accessed at a convenient time. Preferably software is provided so that a scrollable list of all files stored on the drive is available so that an operator may quickly select desired data for display. Data can also be printed to provide a hard copy. Preferably for quick analysis some data screens are available immediately.

For instance, a list of preset information is preferably available and may be provided in engineering units. A list of time-tagged torpedo velocity is provided versus time, such as a graph of velocity in the x-direction vs. time. Acceleration information is also available. Status of each launch signal discrete values may be provided at desired intervals, such as at 100 millisecond intervals. Thus, a listing of time-tagged battery, crossover power sources and power supplies are preferably provided at 100 millisecond intervals. All screens can be dumped to a printer or to a floppy disk. The current test torpedo battery voltage is also available upon command. An end of run locater is turned on during torpedo operation and is turned off during data extraction.

Thus, test torpedo 12 is provided to allow validation of a submarine weapons fire control system down to the end units. Test torpedo 12 is essentially an actual fleet issue torpedo without a warhead, such as a 21-inch diameter variety, that can be loaded into a torpedo tube and ejected for testing pre-launch and post-launch data that is a result of the submarine weapons fire control system effort to successfully launch a torpedo. Internal data recorder 24 passively connects to numerous data, sensor, and power supply circuitry internal to test torpedo 12 and records it for future playback and quantitative analysis. After retrieval of test torpedo 12 and prior to being loaded into a subsequent torpedo tube for further testing, data can be extracted and saved using data extractor 14 that essentially includes portable downloader unit 16 and portable computer 18. Data is extracted using a replaceable A-cable 76 that effectively forms part of an umbilical connection 34 that is normally present on a standard fleet issued torpedo and through which communication is made with the submarine weapons fire control system when the torpedo is in the launch tube. Certain data can be available immediately for on the spot evaluation and all data is stored for further evaluation. It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for testing a weapon control system, said weapon control system having a tube launcher from which a fleet issue vehicle is launchable, said system comprising:

a launchable test vehicle, said launchable test vehicle being sized as said fleet issue vehicle and being operable for insertion and launching from said tube launcher, said launchable test vehicle having no warhead or fuel, said launchable test vehicle having at least one sensor mounted to said test vehicle, said test vehicle having a plurality of power supplies;

a data recorder for said launchable test vehicle, said data recorder being passively connected for monitoring data related to said at least one internal sensor and data related to said plurality of power supplies prior to, during, and subsequent to said launchable test vehicle being launched from said tube launcher; and a data extractor connectable to said launchable test vehicle after said test vehicle is launched from said tube for communication with said data recorder.

2. The system of claim 1 further comprising:

a vehicle control for receiving information from said at least one sensor; and an interlock for preventing or allowing production of a motor start signal in accord with said information from said at least one sensor.

3. The system of claim 1 further comprising:

weights secured to said test vehicle in place of said warhead and said fuel for adjusting a weight of said test vehicle to be substantially the same as said fleet issue vehicle.

4. The system of claim 1 further comprising:

an umbilical electrical connection, said data extractor being removably connected to said umbilical electrical connection.

5. The system of claim 1 further comprising:

a power supply for said data recorder.

6. The system of claim 5 further comprising:

a crossover circuit in said launchable test vehicle for controlling origin of power in said launchable test vehicle; and said power supply for said data recorder being switched on by said crossover circuit.

7. The system of claim 1 further comprising:

a fleet issue replacement guidance wire, and a fleet issue replacement gyro.

8. A system for testing a weapon control system, said weapon control system having a tube launcher from which a fleet issued vehicle is launchable, said system comprising:

a launchable test vehicle, said launchable test vehicle being configured as said fleet issue vehicle and being sized and arranged for insertion and launching from said tube launcher, said launchable test vehicle having a test vehicle control system;

a data recorder for said launchable test vehicle, said data recorder being passively connected for monitoring data from test vehicle control system while said launchable test vehicle is inserted and launched from said tube;

an umbilical connection within said test vehicle being connectable to said weapon control, said umbilical connection being separable from weapon control when said launchable test vehicle is launched; and a portable data extractor connectable to said launchable test vehicle after said test vehicle is launched from said tube launcher and retrieved, said data extractor connecting to said data recorder through said umbilical connection.

9. The system of claim 8 wherein said portable data extractor further comprises:

a portable computer for retrieving and displaying data from said data recorder.

10. The system of claim 9 wherein said portable data extractor further comprises:

a portable power supply.

11. The system of claim 9 wherein said portable computer is operable for immediately displaying said data with respect to time, said data comprising time-tagged test vehicle velocity.

12. The system of claim 9 wherein said portable computer is operable for immediately displaying said data with respect to time, said data comprising at least one battery voltage, a cross-over power source, and at least one power supply voltage.

13. The system of claim 9 wherein said portable computer is operable for immediately displaying said data with respect to time, said data comprising a plurality of launch sequence control signals.

14. A method for testing a weapon control system that includes a plurality of tube launchers for launching a fleet vehicle sized to be ejected from said tube launcher, said weapon control system having a weapon control power supply, said method comprising:

inserting a data recorder into a test vehicle;

attaching lines from said data recorder to at least one vehicle control of said test vehicle;

attaching lines from said data recorder to a vehicle power circuit that includes a cross-over between an internal vehicle power and said weapon control system power supply;

inserting said test vehicle into a first of said plurality of tube launchers;

initiating a first launch sequence to thereby launch said test vehicle from said first of said plurality of tube launchers;

retrieving said test vehicle;

inserting said test vehicle into a second of said plurality of tube launchers; and initiating a second launch sequence to thereby launch said test vehicle from said second of said plurality of tube launchers.

15. The method of claim 14 further comprising:

removing selected components from said fleet vehicle to form said test vehicle.

16. The method of claim 14 further comprising:

recording data with said data recorder relating to said at least one vehicle control and said cross-over between said internal vehicle power and said weapon control system power supply.

17. The method of claim 14 further comprising:

extracting data related to at least one of said first or second launch sequences.

18. The method of claim 14 further comprising:

making an electrical connection between said weapon control system and said test vehicle, and breaking said electrical connection during at least one of said first or second launch sequences.

19. The method of claim 14 further comprising:

providing a portable data extractor;

connecting said portable data extractor to said test vehicle after said retrieving of said test vehicle; and extracting data from said data recorder.

20. The method of claim 14 further comprising:

providing a computer program related to said extracting of data from said data recorder.

* * * * *